United States Patent [19]

White et al.

[11] Patent Number: 5,019,227

[45] Date of Patent: May 28, 1991

[54] ELECTROCHEMICAL METHOD FOR PRODUCING HYDROGEN AND SULFUR

[75] Inventors: Ralph E. White, College Station; Zhenhua Mao, Bryan; Supramaniam Srinivasan, both of College Station, all of Tex.

[73] Assignee: The Texas A&M University System, College Station, Tex.

[21] Appl. No.: 433,698

[22] Filed: Nov. 9, 1987

[51] Int. Cl.[5] ..... C25B 1/00; C25B 1/02

[52] U.S. Cl. ..... 204/128; 204/92; 204/129; 204/130; 423/573.1

[58] Field of Search ..... 204/92, 128, 129, 130; 423/573.1

[56] References Cited

U.S. PATENT DOCUMENTS

| | | | |
|---|---|---|---|
| 1,891,974 | 12/1932 | Fischer . | |
| 2,839,381 | 6/1958 | Lee . | |
| 3,249,522 | 5/1966 | Bolmer | 204/92 |
| 3,409,520 | 11/1968 | Bolmer | 204/129 |
| 4,038,366 | 7/1977 | Fukuda et al. | 204/128 |
| 4,436,713 | 3/1984 | Olson | 423/226 |
| 4,443,424 | 4/1984 | Olson | 423/226 |
| 4,526,774 | 7/1985 | Maas, Jr. et al. | 423/573.1 |
| 4,540,561 | 9/1985 | Olson | 423/226 |
| 4,544,461 | 10/1985 | Venkatesan et al. | 204/128 |
| 4,772,366 | 9/1988 | Winnick | 204/128 |

OTHER PUBLICATIONS

Extended Abstract No. 549, Electrochemical Soc. Spring Meeting (1988).

J. Electroanal. Chem., "An Investigation of the Sulphur(-II)/Sulphur(0) System on Gold Electrodes", vol. 216:213-227 (1987).

J. Electrochem. Soc., "Electrochemical Removal of $H_2S$ from Hot Gas Streams", vol. 134(10):2451-2458 (1987).

Advancing Toward Technology Breakout in Energy Conversion, a Symposium of the 21st InterSociety Energy Conversion Engineering Conference, vol. 1:262-265 (1986).

Proc. Symp. On Diaphragms, Separators, and Ion-Exchange Membranes, "Electrolysis of Hydrogen Sulfide in Aqueous Alkaline Solutions", pp. 228-237 (1986).

Inorganic Chemistry, "Numerical Analysis of Aqueous Polysulfide Solutions and Its Application to Cadmium Chalcogenide/Polysulfide Photoelectrochemical Solar Cells", vol. 25:2486-2489 (1986).

J. Appl. Electrochem., "Electrochemical Reactions of $H_2S$ in Molten Sulphide", vol. 16:583-590 (1986).

Int. J. Hydrogen Energy, "Indirect Hydrogen Sulfide Conversion—I. An Acidic Electrochemical Process", vol. 10(3):157-162 (1985).

Int. J. Hydrogen Energy, "Indirect Hydrogen Sulfide Conversion—II. A Basic Electrochemical Process", vol. 10(3):163-167 (1985).

Electrochimica Acta, "Electrochemical Removal of $H_2S$ from Hot Coal Gas: Electrode Kinetics", vol. 30(4):511-519 (1985).

J. Electrochem. Soc., "Sulfur Chemistry in Equimolar NaOH-$H_2O$ Melt", vol. 13(7):1545-1551 (1984).

J. Electrochem. Soc., "Sulfur Chemistry in Equimolar NaOH-$H_2O$ Melt", vol. 13(7):1538-1544 (1984).

J. Electrochem. Soc., "Electrochemical Removal and Concentration of Hydrogen Sulfide from Coal Gas", vol. 13(3):562-568 (1984).

(List continued on next page.)

*Primary Examiner*—T. Tung
*Assistant Examiner*—David G. Ryser
*Attorney, Agent, or Firm*—Arnold, White & Durkee

[57] ABSTRACT

A process for the electrochemical production of hydrogen gas and sulfur from hydrogen sulfide gas is disclosed. The process includes forming a substantially equimolar mixture of hydrosulfide and sodium hydrogen. That mixture is transferred to the anodic compartment of an electrochemical cell that includes a membrane that separates the anodic and cathodic compartments. A substantially pure sodium hydroxide solution is transferred to the cathodic compartment. Passage of an electric current through the electrolyte causes hydrogen gas to be produced at the cathode and sulfur in the anodic compartment.

25 Claims, 2 Drawing Sheets

OTHER PUBLICATIONS

J. Electrochem. Soc., "Thermodynamics of Aqueous Sulfur Species to 300° C. and Potential-pH Diagrams", vol. 130(4):866-869 (1983).

J. Appl. Electrochem, "An Investigation of the Deposition and Reactions of Sulphur on Gold Electrodes", vol. 13:783-794 (1983).

J. Electrochem. Soc., "Transport Properties of Nafion Membranes for Use in Three-Electrode Photoelectrochemical Storage Cells", vol. 129:2469-2473 (1982).

Electrochimica Acta, "The Anodic Evolution of Sulphur from Sodium Polysulphide Melts—II. Microscopic Studies with Thin Layer Cells", vol. 22:609-614 (1977).

Inorganic Chemistry, "Equilibria Involving Polysulfide Ions in Aqueous Sulfide Solutions up to 240°", vol. 13(7):1724-1730 (1974).

Inorganic Chemistry, "Kinetics of the Polysulfide-Thiosulfate Disproportionation up to 240°", vol. 13(7):1730-1733 (1974).

Inorganic Chemistry "Optical Spectra and Equilibrium Distribution of Polysulfide Ions in Aqueous Solution at 20°," vol. 11(6):1201-1207.

Acta Chemica Scand., "The Equilibrium Between Elementary Sulfur and Aqueous Polysulfide Solutions", vol. 25:1722-1728 (1971).

Science, "Saturation Curves of Orthorhombic Sulfur in the System S-$Na_2S$-$H_2O$ at 25° and 50° C.", vol. 128:716-718 (1958).

Trans. Faraday Soc., "Electrochemistry of Sulphur", vol. 53:1626-1635 (1957).

J. Amer. Chem. Soc., "Exchange Reactions with Radiosulfur", vol. 61:1032-1035 (1939).

J. Phys. Chem. "The Electrolysis of Sodium Sulphide Solutions", vol. 32:1787-1807 (1932).

Final Report in connection with Contract No. 68-0-2-4425 to Environmental Protection Agency.

SRI Project No. 8030.

Final Report in connection with Contract No. 68-0-2-4529 to Environmental Protection Agency with cover letter.

Pre-proposal on hydrogen sulfide cleanup to GRI with cover letter.

Proposal to $H_2$ Industry Council with cover letter.

Proposal to Environmental Protection Agency, "Separation of Hydrogen Sulfide from Natural Gas and Other Fossil Fuels and Its Utilization for Electrochemical Production of Hydrogen and Sulfur".

ELECTROCHEMICAL METHOD FOR PRODUCING HYDROGEN AND SULFUR

BACKGROUND OF THE INVENTION

The present invention relates to a process for removing sulfides. The invention has particular application to the removal of sulfides from hydrogen sulfide gas to produce hydrogen gas and sulfur.

Hydrogen sulfide is often present in large quantities in natural gas reserves, petroleum and coal. Its removal is essential to clean up fossil fuels. Its conversion to valuable products is desirable to minimize the cost of its removal. One approach that has been attempted is to convert hydrogen sulfide into hydrogen gas and sulfur electrochemically.

Previous investigations on the electrolysis of hydrogen sulfide led to the passivation of the anode in the first few minutes of the electrolysis. See U.S. Pat. No. 1,891,974, U.S. Pat. No. 3,409,520, and U.S. Pat. No. 4,544,461. To avoid this problem, researchers have attempted indirect electrolysis of hydrogen sulfide in which iodine precipitates the sulfur, and electrochemical methods regenerate the iodine and produce hydrogen. See U.S. Pat. No. 2,839,381 and Kalina et al., *Int. J. Hydrogen Energy,* Vol. 10, p. 157 (1985). It is reported that the sulfur obtained by this indirect process is plastic in nature and needs further purification.

Electrolysis of hydrogen sulfide in aqueous alkaline solutions at 85° C. using carbon electrodes has also been reported. See Dandapani et al., in "Advancing Toward Technology Breakout in Energy Conversion," a Symposium of the 21st Intersociety Energy Conversion Engineering Conference, Vol. 1, p. 262 (1986). The reported process saturates an anodic compartment with $H_2S$ gas. This appears to lead to passivation of the anode.

There is a need for a low temperature electrochemical method for removing sulfides from sulfide containing solutions that is not restricted by passivation of the anode. There is a need for such a method that produces hydrogen and sulfur from hydrogen sulfide gas with an efficiency that does not decrease with time. The process of the present invention provides such a method.

SUMMARY OF THE INVENTION

The present invention provides a method for removing sulfide ions from a sulfide ion containing solution comprising:

forming a mixture containing the sulfide ion containing solution and a sulfide concentration balancing amount of a basic solution; and electrochemically precipitating sulfur from the mixture in an electrochemical cell.

When sulfide ions are to be removed from hydrogen sulfide gas, the method preferably comprises the steps of:

forming a mixture containing a hydrosulfide solution and a sulfide concentration balancing amount of a basic solution;

transferring the mixture to the anodic compartment of an electrochemical cell having an anodic compartment having an anode and a cathodic compartment having a cathode;

transferring a zero valence sulfur lacking basic solution to the cathodic compartment of the electrochemical cell; and passing an electric current through the mixture and the zero valence sulfur lacking basic solution at a sufficient current density for a sufficient time period to produce hydrogen gas at the cathode in the cathodic compartment, and sulfur precipitate in the anodic compartment.

DETAILED DESCRIPTION OF SPECIFIC EMBODIMENTS

Figure 1:
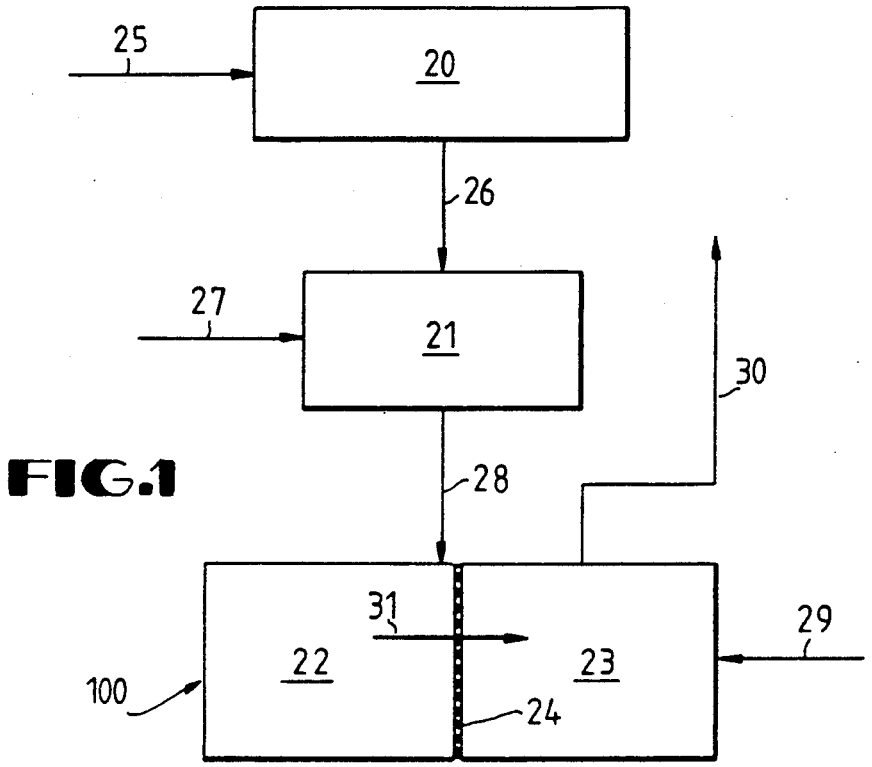
FIG. 1 is a schematic process flow diagram of an embodiment of the process of the present invention.

This invention is a novel process for removing sulfide ions from sulfide ion containing solutions, such as solutions containing hydrosulfide. In the process of the present invention, a sulfide ion containing solution is mixed with a sulfide concentration balancing amount of a basic solution. The resulting mixture is subjected to electrolysis in an electrochemical cell precipitating sulfur from the mixture.

Sulfide ion containing solutions that may be subjected to the process of the present invention may be those present in fossil fuels and waste waters. The specific embodiments described below refer to removal of sulfides from hydrogen sulfide gas. The process of the present invention, however, may be used to remove sulfide ions from solutions other than hydrosulfide containing solutions. It is not limited to removal of sulfide ions from such solutions.

The basic solution for use in the process is any solution that, when mixed with a sulfide ion containing solution, provides a mixture that is sulfide concentration balanced Such a mixture, when subjected to electrolysis, will not produce substantial amounts of oxidized sulfide products such as sulfates, dithionates, sulfites and thiosulfates. Such a mixture will not cause sulfur to deposit on the anode passivating the anode.

Such basic solutions may include alkali metal hydroxides, salts of an alkali metal and a halogen, or mixtures of such hydroxides and salts. Preferred alkali metal hydroxides for use as the basic solution used in the present invention include sodium hydroxide and potassium hydroxide. Preferred salts include sodium chloride and potassium chloride It should be appreciated that any basic solution that, when combined with a sulfide ion containing solution in an appropriate amount, balances the sulfide concentration to render the mixture sulfide oxidation and anode passivation neutralized may be used in the process of the present invention.

The amount of such a basic solution necessary to produce a sulfide concentration balanced mixture (hereinafter referred to as the "balanced mixture") may depend upon the sulfide ion containing solution being processed and the nature of the basic solution used in the process. For removal of sulfide ions from hydrosulfide, the basic solution preferably includes a strong base, such as sodium or potassium hydroxide A sufficient amount of such a basic solution should be added to yield a mixture that includes hydrosulfide and the strong base in a molar ratio of between about 2:1 and about 2:3.

If the molar ratio of hydrosulfide to the strong base is 2:1 or greater, then the solution should become too acidic. Subjecting such a solution to electrolysis should passivate the anode. If the molar ratio of hydrosulfide to the strong base is 2:3 or less, polysulfides formed by electrolysis may be further oxidized to sulfur oxyanions such as thiosulfate, sulfite, and other oxidized species, because of the high solubility of sulfur in such a solution and the availability of excess hydroxide ions for oxidation.

To prevent such problems, such a mixture preferably should include a substantially equimolar mixture of hydrosulfide and the strong base. If a weak base is employed instead in the basic solution, a significantly larger amount of the weak base must be added to neutralize the hydrosulfide containing solution.

To produce a sulfide concentration balanced mixture, it is important that the sulfur solubility in the mixture is neither too low nor too high. If sulfur is insoluble in the solution, as is the case in an acidic solution, then the sulfur formed by electrolysis could adhere to the electrode surface and block the electrode. If the solubility of sulfur in the solution is too high, the sulfur may not precipitate out of solution.

The electrochemical cell for use in the electrolysis of the balanced mixture may be any type of electrochemical cell conventionally used for such processes. The anode, cathode, and reference electrodes for use in the present invention likewise are those used in standard electrolysis methods. Anodes may be composed of graphite, transition metals (such as nickel, chromium or cobalt) or their alloys (such as a nickel-chromium alloy), or some photoelectrochemically active materials, such as cadmium selenide. Cathodes may be composed of similar types of materials.

To prevent polysulfide species from contacting the cathode, an ion selective membrane that is substantially impenetrable to negatively charged sulfide and polysulfide ions preferably should be positioned between the anodic compartment and the cathodic compartment of the electrochemical cell. In a process that includes a cell with such a membrane, the balanced mixture preferably is fed into the anodic compartment, while a zero valence sulfur lacking basic solution is fed into the cathodic compartment. As in any conventional electrochemical process, an electrical potential difference is generated between the anode and the cathode to cause current to flow through the mixture for a time sufficient to cause sulfur to form in the anodic compartment and hydrogen gas to form at the cathode.

FIG. 1 provides a schematic process flow diagram for a preferred embodiment of the process of the present invention for producing hydrogen gas and sulfur from hydrogen sulfide gas. In that preferred embodiment, the sulfide ion containing solution is formed by absorption of hydrogen sulfide gas (as indicated by line 25) in an alkaline solution in scrubber 20 to produce a saturated hydrosulfide containing solution. That solution is fed into sulfide concentration balancing chamber 21 (as indicated by line 26). A sufficient amount of a basic solution, such as a solution containing sodium hydroxide, is fed into chamber 21 (as indicated by line 27) to balance the sulfide concentration. (It may be possible to remove chamber 21 and perform the sulfide concentration balancing function in scrubber 20. Chamber 21 is shown in FIG. 1 to emphasize the need to generate a hydrosulfide containing solution having a balanced concentration ratio, which would differ from the concentration ratio at saturated conditions—the concentration ratio normally present in scrubber 20.)

The resulting mixture is then fed into the anodic compartment 22 of electrochemical cell 100 (as indicated by line 28). A zero valence sulfur lacking basic solution, such as a substantially pure sodium hydroxide aqueous solution, is fed into cathodic compartment 23 of electrochemical cell 100 (as indicated by line 29). An electrical potential difference is generated between the anode and the cathode causing an electric current to pass through the mixture and the zero valence sulfur lacking basic solution at a sufficient current density for a sufficient time period to produce hydrogen gas at the cathode in cathodic compartment 23, and sulfur precipitate in anodic compartment 22.

The solution in anodic compartment 22 can be filtered to remove the sulfur precipitate from the solution. Hydrogen gas bubbling off of the cathode (as indicated by line 30) may be collected by any conventional gas collection device.

FIG. 1 shows schematically a membrane 24 positioned between anodic compartment 22 and cathodic compartment 23 for inhibiting movement of negatively charged sulfide and polysulfide ions from the anodic compartment to the cathodic compartment.

As indicated by line 31 of FIG. 1, the process of the present invention should cause electro-osmosis from the anodic compartment to the cathodic compartment. As shown by the FIG. 2 embodiment, such a flow (indicated by line 46) may permit a flow stream starting from cathodic compartment 43 and leading to scrubber 40 and chamber 41 (indicated by lines 47 and 48) to supply the basic solution to these units. If the amount of water (or other solvent) transferred through membrane 44 through electro-osmosis is insufficient to circulate the electrolyte, solution may be pumped from scrubber 40 to cathodic compartment 43 as shown by the dashed line 49. Membrane 44 also may allow cations to pass from anodic compartment 42 to cathodic compartment 43 to ensure an alkaline pH of the solution in anodic compartment 42. Membrane 44 thus may perform three functions: preventing polysulfide species from contacting the cathode, ensuring maintenance of an alkaline pH of the solution in anodic compartment 42 by allowing only cations to pass through it, and transporting water (or other solvent) from anodic compartment 42 to cathodic compartment 43.

Figure 2:
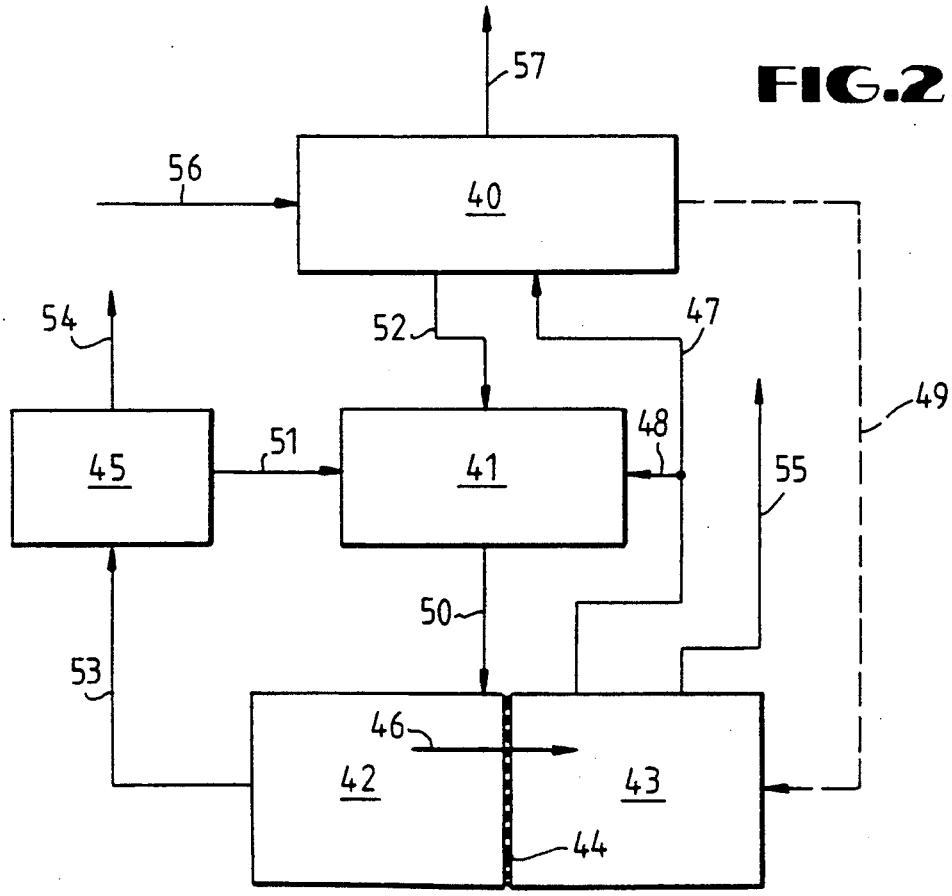
FIG. 2 is a schematic process flow diagram of a second embodiment of the process of the present invention.

FIG. 2 shows sulfur separator 45, which may be any conventionally used separation device for removing sulfur from anodic chamber 42. Because the anolyte may become dilute to the point at which conductivity of the anolyte decreases, a supporting electrolyte (such as an alkali metal halogen salt like sodium chloride), or a solution of high initial concentrations should be used to avoid too much IR loss. To carry out the electrolysis continuously, as shown in the FIG. 2 embodiment, the input solution (indicated by line 50) should be a saturated sulfur solution such that sulfur will begin to precipitate immediately after the solution is subjected to electrolysis. Because the electrolysis in anodic compartment 42 produces more crystalline sulfur than that included in the passed charge (indicated by line 50), it is necessary to recycle a portion of the sulfur formed by electrolysis (as indicated by line 51) to ensure saturation of the input solution.

FIG. 2 shows that the method of the present invention could potentially be used in a system that recycles the basic solution (flowing through lines 48 and 47, and included in the mixtures flowing through lines 50 and 52) to produce sulfur (as indicated by lines 53 and 54) and hydrogen (as indicated by line 55) from hydrogen sulfide containing gas (indicated by line 56). (Line 57 shows the production of hydrogen sulfide free gas from scrubber 40.)

To prevent sulfur build-up on the anode, the temperature of the mixture in anodic compartment 42 preferably should be maintained between about 60° C. and about 110° C. for electrochemical cells operated at atmospheric pressure. The temperature preferably should be less than about 85° C., as higher temperatures may cause polysulfides to disproportionate into sulfur oxyanions. Such an effect could reduce the efficiency of sulfur production. This temperature range would of course be substantially higher for pressurized cells.

Because sulfide ions can be electrolytically oxidized to elemental sulfur, polysulfide and sulfur oxyanions, electrolysis conditions must be selected that form sulfur via polysulfides instead of sulfur oxyanion reaction products The electrical potential difference between the anode and cathode should be chosen to prevent formation of such products The voltage applied to prevent that result, while simultaneously causing sulfur to precipitate, will depend upon such factors as the surface area of the electrodes, the distance between the cathode and the anode, and the conductivity of the balanced mixture. The distance between the cathode and anode should be minimized to reduce ohmic overpotential. The voltage applied and the resistance of the mixture will dictate the current density.

Figure 3:
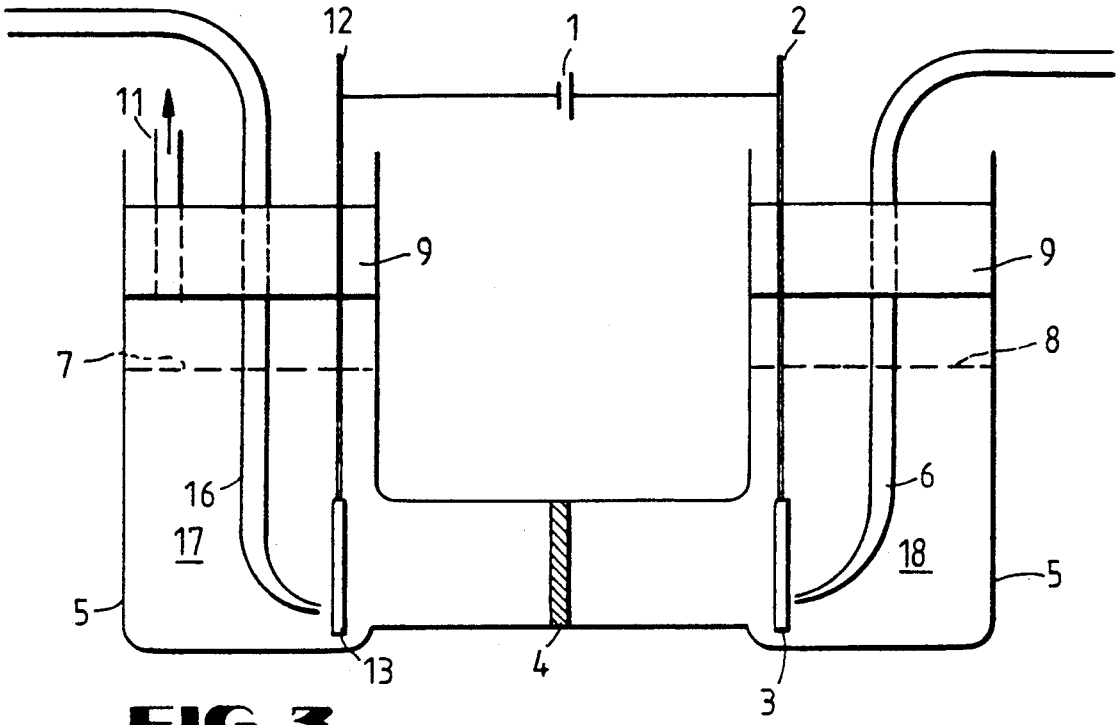
FIG. 3 is a schematic cross-section of an embodiment of laboratory scale electrochemical cell apparatus that may be used in the process of the present invention.

FIG. 3 provides a schematic cross-section of a conventional laboratory scale electrochemical cell that may be used in the present process. Such a cell includes power source 1, current collectors 2, 12, anode 3, cathode 13, ion selective membrane 4, cell case 5, capillaries 6, 16, and lead through seal 9. The anolyte is preferably maintained at anolyte level 8, and the catholyte at catholyte level 7. FIG. 3 shows hydrogen gas outlet 11 for removal of hydrogen gas from cathodic compartment 17.

Anode 3 and cathode 13 may be conventionally used graphite electrodes. The temperature of the solution within anodic compartment 18 and cathodic compartment 17 preferably should be maintained between about 75° C. and about 85° C. Membrane 4 is an ion selective type membrane (Nafion®, DuPont).

The pH of the anodic compartment 18 should be maintained above about 9.0 (e.g., above the pH of the saturated hydrosulfide solution flowing from the scrubber) and below about 14.0 to inhibit formation of oxidized sulfide products (such as sulfates, dithionates, sulfites, and thiosulfates) and passivation of the anode. Temperatures above 100° C. and excessive alkalinity such as a pH above 13.7, should be avoided to achieve optimum current efficiency.

Figure 4:
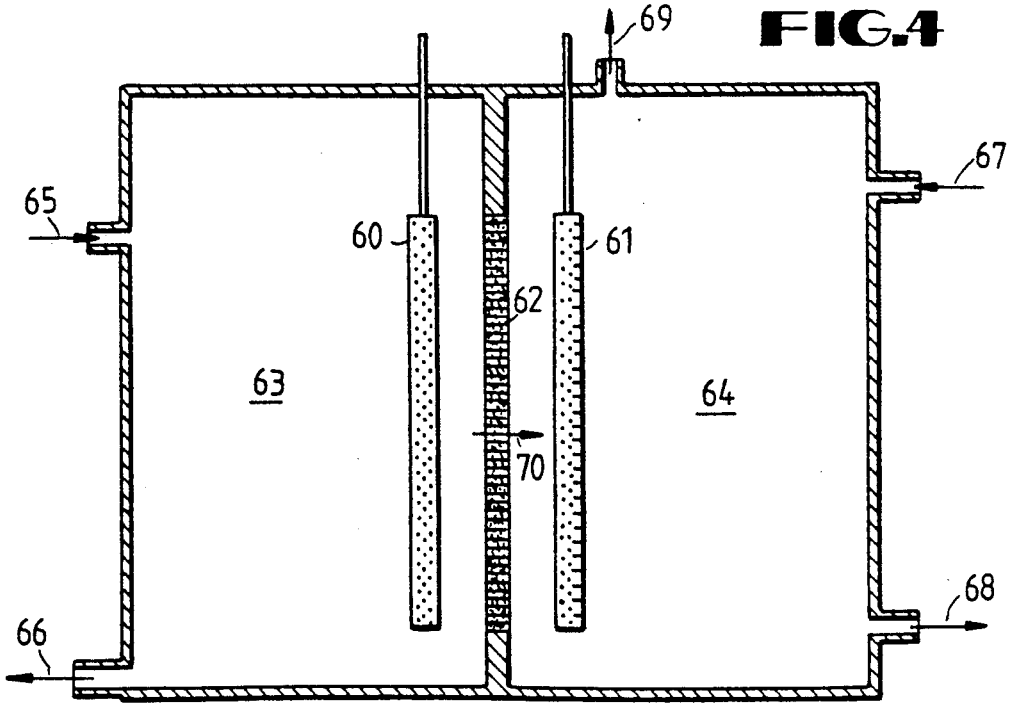
FIG. 4 is a schematic cross-section of an embodiment of commercial scale electrochemical cell apparatus that may be used in the process of the present invention.

FIG. 4 shows apparatus for a commercial embodiment of the electrochemical cell that may be used in the present invention. FIG. 4 shows anode 60, within anodic compartment 63, and cathode 61, within cathodic compartment 64. Anodic compartment 63 and cathodic compartment 64 are shown separated by ion selective membrane 62. The distance between anode 60 and cathode 61 should be minimized as much as possible.

FIG. 4 shows input solution (from the sulfide concentration balancing chamber) flowing into anodic compartment 63 (as shown by arrow 65) and a basic solution flowing into cathodic compartment 64 (as indicated by arrow 67). (If the flow from anodic compartment 63 to cathodic compartment 64—shown by arrow 70—is sufficient, then it may not be necessary to feed additional basic solution into cathodic compartment 64.) Sulfur precipitate is removed from anodic compartment 63 (as shown by arrow 66), hydrogen gas is removed from cathodic compartment 64 (as shown by arrow 69), and basic solution is removed from cathodic compartment 64 for circulation to the sulfide concentration balancing chamber and the scrubber (as shown by arrow 68).

The following example is illustrative of the present invention. It will be appreciated, of course, that the proportion and type of components and the type of apparatus, as well as reaction conditions, are variable Selection of different sulfide ion sources, basic solutions, and electrochemical cell components and operating conditions can readily be made. The example, therefore, is not in any way to be construed as limiting the scope of the present invention.

EXAMPLE $H_2S$ gas was pumped into a beaker that included 200 ml of a 1M NaOH aqueous solution, until the solution became saturated with NaHS. 25 ml of that saturated solution was mixed with 25 ml of a 1M NaOH aqueous solution forming a 50 ml equimolar solution of NaOH and NaHS having a balanced sulfide concentration.

25 ml of that resulting aqueous mixture (containing $HS^-$ and $OH^-$ in a molar ratio of about 1:1) was fed into the anodic compartment of an electrochemical cell. 25 ml of a substantially pure 1M NaOH aqueous solution was fed into the cathodic compartment of the electrochemical cell. The electrochemical cell used was a conventional H-cell having a graphite anode, a graphite cathode, and an Hg/HgO reference electrode (immersed in a 1M NaOH solution outside of the H-cell). The power source was a Solartron Programmable Electrochemical Interface Model #1286. The cell included an ion selective membrane (Nafion®, DuPont) positioned within the cell to separate the anodic and cathodic compartments. The anode was separated from the cathode by about 4 cm. The temperature of the electrolyte was maintained at about 80° C.±5° C. by immersing the H-cell in a constant temperature water bath maintained at that temperature.

A current density that varied from about 20 $mA/cm^2$ to about 100 $mA/cm^2$ was applied until substantially all of the sulfur precipitated out of solution. Hydrogen gas bubbled off the cathode and was collected over water. Hydrogen evolved at nearly 100% efficiency. The sulfur was separated from the anodic compartment by filtration. The filtrate was clear.

Additional advantages and modifications will readily occur to those skilled in the art. The invention in its broader aspects is, therefore, not limited to the specific details and the illustrative examples as shown and described. Departures may be made from the detail without departing from the spirit or scope of the disclosed general inventive concept.

What is claimed is:

1. A method for removing sulfide ions from a sulfide ion containing solution comprising:

providing a sulfide ion containing solution forming a mixture containing the sulfide ion containing solution by adding a sulfide concentration balancing amount of a basic solution; and electrochemically precipitating sulfur from the mixture in an electrochemical cell.

2. The method of claim 1 in which the sulfide ion containing solution is a hydrosulfide containing solution.

3. The method of claim 2 further including the step of absorbing hydrogen sulfide gas in an alkaline solution producing the hydrosulfide containing solution.

4. The method of claim 3 in which the basic solution is a sodium hydroxide containing solution.

5. The method of claim 4 further including the step of feeding the mixture into the electrochemical cell after forming the mixture.

6. The method of claim 5 in which the electrochemical cell includes an anodic compartment that includes an anode, a cathodic compartment that includes a cathode, and a membrane that is substantially impenetrable to negatively charged sulfide and polysulfide ions that divides the anodic compartment from and the cathodic compartment.

7. The method of claim 6 further including the steps of feeding the mixture into the anodic compartment and feeding a zero valence sulfur lacking sodium hydroxide solution into the cathodic compartment, and in which the membrane inhibits movement of negatively charged sulfide and polysulfide ions from the anodic compartment to the cathodic compartment.

8. The method of claim 7 further including the step of producing hydrogen gas at the cathode.

9. The method of claim 8 in which the mixture includes hydrosulfide and sodium hydroxide in a molar ratio of between about 2:1 and about 2:3.

10. The method of claim 9 in which the mixture includes substantially equimolar amounts of hydrosulfide and sodium hydroxide.

11. A method for removing sulfide ions from a sulfide ion containing solution comprising:

providing a sulfide ion containing solution;

forming a mixture containing the sulfide ion containing solution by adding a basic solution comprising hydroxide ions in which the molar ratio of the sulfide ions to the hydroxide ions is between about 2:1 and about 2:3; and electrochemically precipitating sulfur from the mixture in an electrochemical cell.

12. The method of claim 11 in which the mixture includes substantially equimolar amounts of sulfide ions and hydroxide ions.

13. A method for producing hydrogen gas and sulfur from hydrogen sulfide gas comprising:

providing a hydrosulfide containing solution;

forming a mixture containing the hydrosulfide containing by adding solution a sulfide concentration balancing amount of a basic solution;

transferring the mixture to an anodic compartment of an electrochemical cell having an anodic compartment having an anode and a cathodic compartment having a cathode;

transferring a zero valence sulfur lacking basic solution to the cathodic compartment of the electrochemical cell; and passing an electric current through the mixture and the zero valence sulfur lacking basic solution at a sufficient current density for a sufficient time period producing hydrogen gas at the cathode in the cathodic compartment, and sulfur precipitate in the anodic compartment.

14. The method of claim 13 further including the steps of:

providing the hydrosulfide containing solution by absorbing hydrogen sulfide gas in an alkaline solution before forming the mixture; and separating the sulfur precipitate from the anodic compartment and the hydrogen gas from the cathodic compartment.

15. The method of claim 13 in which the basic solution is selected from the group consisting of solutions that comprise alkali metal hydroxides, salts of an alkali metal and a halogen, and mixtures thereof.

16. The method of claim 15 in which the mixture is a substantially equimolar mixture of hydrosulfide and a composition selected from the group consisting of sodium hydroxide, potassium hydroxide, sodium chloride, potassium chloride, and mixtures thereof.

17. The method of claim 16 further including the steps of maintaining the pH of the mixture between about 9.0 and about 14.0 and heating the mixture and the zero valance sulfur lacking basic solution to a temperature between about 60° C. and about 110° C.

18. A method for producing hydrogen gas and sulfur from hydrogen sulfide gas comprising:

providing a hydrosulfide containing solution;

forming a mixture containing the hydrosulfide containing solution by adding a basic solution comprising hydroxide ions in which the molar ratio of the hydrosulfide to the hydroxide ions is between about 2:1 and about 2:3;

transferring the mixture to an anodic compartment of an electrochemical cell having an anodic compartment having an anode and a cathodic compartment having a cathode;

transferring a zero valence sulfur lacking basic solution to the cathodic compartment of the electrochemical cell; and passing an electric current through the mixture and the zero valence sulfur lacking basic solution at a sufficient current density for a sufficient time period to produce hydrogen gas at the cathode in the cathodic compartment, and sulfur precipitate in the anodic compartment.

19. The method of claim 18 in which the mixture includes substantially equimolar amounts of hydrosulfide and hydroxide ions.

20. A method for producing hydrogen gas and sulfur from hydrogen sulfide gas comprising:

absorbing hydrogen sulfide gas in a solution comprising a composition selected from the group consisting of sodium hydroxide, potassium hydroxide, sodium chloride, potassium chloride, and mixtures thereof, forming a hydrosulfide containing solution;

adding a sulfide concentration balancing amount of a solution comprising a composition selected from the group consisting of sodium hydroxide, potassium hydroxide, sodium chloride, potassium chloride, and mixtures thereof, to the hydrosulfide containing solution forming a mixture;

transferring the mixture to an anodic compartment of an electrochemical cell having an anode compartment having an anode, a cathodic compartment having a cathode, and a membrane that is substantially impenetrable to negatively charged sulfide and polysulfide ions that divides the anodic compartment from the cathodic compartment of the electrochemical cell;

transferring a solution comprising selected from the group consisting of sodium hydroxide, potassium hydroxide, sodium chloride, potassium chloride, and mixtures thereof, to the cathodic compartment of the electrochemical cell;

passing an electric current through the mixture producing hydrogen gas at the cathode in the cathodic compartment and sulfur precipitate in the anodic compartment; and separating the sulfur precipitate from the anodic compartment and the hydrogen gas from the cathodic compartment.

21. The method of claim 16 further including the steps of absorbing the hydrogen sulfide gas in a solution comprising a composition selected from the group consisting of sodium hydroxide, sodium chloride, and a mixture of sodium hydroxide and sodium chloride, adding to the hydrosulfide containing solution a solution comprising a composition selected from the group consisting of sodium hydroxide, sodium chloride, and a mixture of sodium hydroxide and sodium chloride, and transferring a solution to a cathodic compartment of the electrochemical cell comprising a composition selected from the group consisting of sodium hydroxide, sodium chloride, and a mixture of sodium hydroxide and sodium chloride.

22. The method of claim 21 in which the mixture includes a substantially equimolar mixture of hydrosulfide and a composition selected from the group consisting of sodium hydroxide, sodium chloride, and a mixture of sodium hydroxide and sodium chloride.

23. The method of claim 22 further including the step of heating the mixture to a temperature between about 60° C. and about 110° C.

24. A method for producing hydrogen gas and sulfur from hydrogen sulfide gas comprising:

absorbing hydrogen sulfide gas in a solution comprising sodium hydroxide to produce a hydrosulfide containing solution;

adding a sufficient amount of sodium hydroxide to the hydrosulfide containing solution to form a mixture that includes hydrosulfide and sodium hydroxide in a molar ratio between about 2:1 and about 2:3.

transferring the mixture to an anodic compartment of an electrochemical cell having an anodic compartment having an anode, a cathodic compartment having a cathodic, and a membrane that is substantially impenetrable to negatively charged sulfide and polysulfide ions that divides the anodic compartment from the cathodic compartment of the electrochemical cell;

transferring a zero valence sulfur lacking sodium hydroxide containing solution to the cathodic compartment of the electrochemical cell;

heating the mixture to a temperature between about 60° C. and about 110° C.;

passing an electric current through the mixture producing hydrogen gas at the cathode in the cathodic compartment and sulfur precipitate in the anodic compartment; and separating the sulfur precipitate from the anodic compartment and the hydrogen gas from the cathodic compartment.

25. The method of claim 24 further including the step of adding a sufficient amount of sodium hydroxide to the hydrosulfide containing solution forming a mixture that includes substantially equimolar amounts of hydrosulfide and sodium hydroxide.

* * * * *

UNITED STATES PATENT AND TRADEMARK OFFICE

CERTIFICATE OF CORRECTION

PATENT NO. : 5,019,227

DATED : May 28, 1991

INVENTOR(S) : R. E. White, Z. Mao, A. Anani, S. Srinivasan

It is certified that error appears in the above-identified patent and that said Letters Patent is hereby corrected as shown below:

ON THE TITLE PAGE:

Please correct the filing date to reflect --November 9, 1989-- instead of "November 9, 1987".

Please add to the list of inventors the name --Anaba A. Anani and-- before "Supramaniam Srinivasan".

In col. 1, before the title of the invention, please insert the following paragraph:

> --This invention was developed with funding provided by the U.S. Environmental Protection Agency.--

Col. 6;
In claim 1, line 3, please insert a --;-- after "solution".

Col. 7;
In claim 6, line 22, please delete "and".

In claim 13, line 56, please insert --solution-- before "by adding" instead of after "by adding".

UNITED STATES PATENT AND TRADEMARK OFFICE

CERTIFICATE OF CORRECTION

PATENT NO. : 5,019,227

DATED : May 28, 1991

INVENTOR(S) : R.E. White, Z. Mao Anani, S. Srinivasan

It is certified that error appears in the above-identified patent and that said Letters Patent is hereby corrected as shown below:

Col. 9;

In claim 20, line 3, please insert --a composition-- after "comprising".

In claim 21, line 15, please delete "16" and insert therefor --20--.

Col. 10;

In claim 24, line 14, please delete "cathodic" and insert therefor --cathode--.

Signed and Sealed this

Fifteenth Day of December, 1992

*Attest:*

DOUGLAS B. COMER

*Attesting Officer*

*Acting Commissioner of Patents and Trademarks*